US005213540A

United States Patent [19]

Yang

[11] Patent Number: 5,213,540

[45] Date of Patent: May 25, 1993

[54] WAVE GENERATING AQUATIC TOY DEVICE

[76] Inventor: Tsai-Ten Yang, No. 23, Sec. 1, Chung-Hwa W. Rd., Tainan City, Taiwan

[21] Appl. No.: 718,331

[22] Filed: Jun. 14, 1991

[51] Int. Cl.[5] ..... A63H 33/40; A63H 23/00; A63H 3/52; G09F 19/00

[52] U.S. Cl. ..... 446/180; 446/159; 446/267; 40/406; 40/410

[58] Field of Search ..... 446/153, 156, 159, 176, 446/178, 179, 180, 197, 198, 199, 267; 273/457, 140, 145 CA, 145 C; 40/406, 410, 412, 439

[56] References Cited

U.S. PATENT DOCUMENTS

| | | | |
|---|---|---|---|
| 1,190,459 | 7/1916 | LeMoine et al. | 40/406 |
| 1,454,426 | 5/1923 | Clements | 40/412 |
| 3,106,394 | 10/1963 | Gelbart | 446/119 X |
| 4,142,715 | 3/1979 | Matsumoto | 273/457 X |
| 4,223,471 | 9/1980 | Greenberg | 446/198 |
| 4,586,280 | 5/1986 | Dang | 446/267 X |
| 4,817,311 | 4/1989 | Ong | 40/406 X |
| 4,923,429 | 5/1990 | Lewis | 446/267 X |
| 5,018,288 | 5/1991 | Yang | 40/411 X |
| 5,131,175 | 7/1992 | Liu | 40/406 X |

FOREIGN PATENT DOCUMENTS

| | | | |
|---|---|---|---|
| 575173 | 4/1933 | Fed. Rep. of Germany | 446/180 |
| 3618952 | 12/1987 | Fed. Rep. of Germany | 446/156 |
| 1442243 | 12/1988 | U.S.S.R. | 446/267 |

OTHER PUBLICATIONS

U. K. Search Report No. 9113145.8.

*Primary Examiner*—Robert A. Hafer
*Assistant Examiner*—D. Neal Muir
*Attorney, Agent, or Firm*—Ladas & Parry

[57] ABSTRACT

An aquatic toy includes a tank containing liquid. The tank includes a bottom part having an upper perforated plate member, a lower guide plate member connected to the upper perforated plate member, and a space formed between the upper perforated plate member and the lower guide plate member. A floatable toy floats on the liquid in the tank. A base is attached to the bottom part of the tank. A liquid propelling unit is provided in the bottom part of the tank which forces the liquid upwards from the space through the upper perforated plate member when it is actuated. A motor is mounted in the base and connected to the liquid propelling unit, actuating the liquid propelling unit.

2 Claims, 10 Drawing Sheets

WAVE GENERATING AQUATIC TOY DEVICE

BACKGROUND OF THE INVENTION

This invention relates to a toy device, more particularly to an aquatic toy device.

In the present age, people need and enjoy some amusement for relaxation after working. They are familiar and all too often bored with old toys available to the market, and therefore seek new forms of amusement.

SUMMARY OF THE INVENTION

The objective of this invention is to provide a new toy, an aquatic toy device, for amusement.

Accordingly, the aquatic toy of this invention includes a tank containing liquid therein. The tank includes a bottom part having an upper perforated plate member, a lower guide plate member connected to the upper perforated plate member, and a space formed between the upper perforated plate member and the lower guide plate member. A floatable toy floats on the liquid in the tank. A base is attached to the bottom part of the tank. A liquid propelling unit is provided in the bottom part of the tank which forces the liquid upwards from the space through the upper perforated plate member when it is actuated. A motor is mounted in the base and connected to the liquid propelling unit, actuating the liquid propelling unit.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
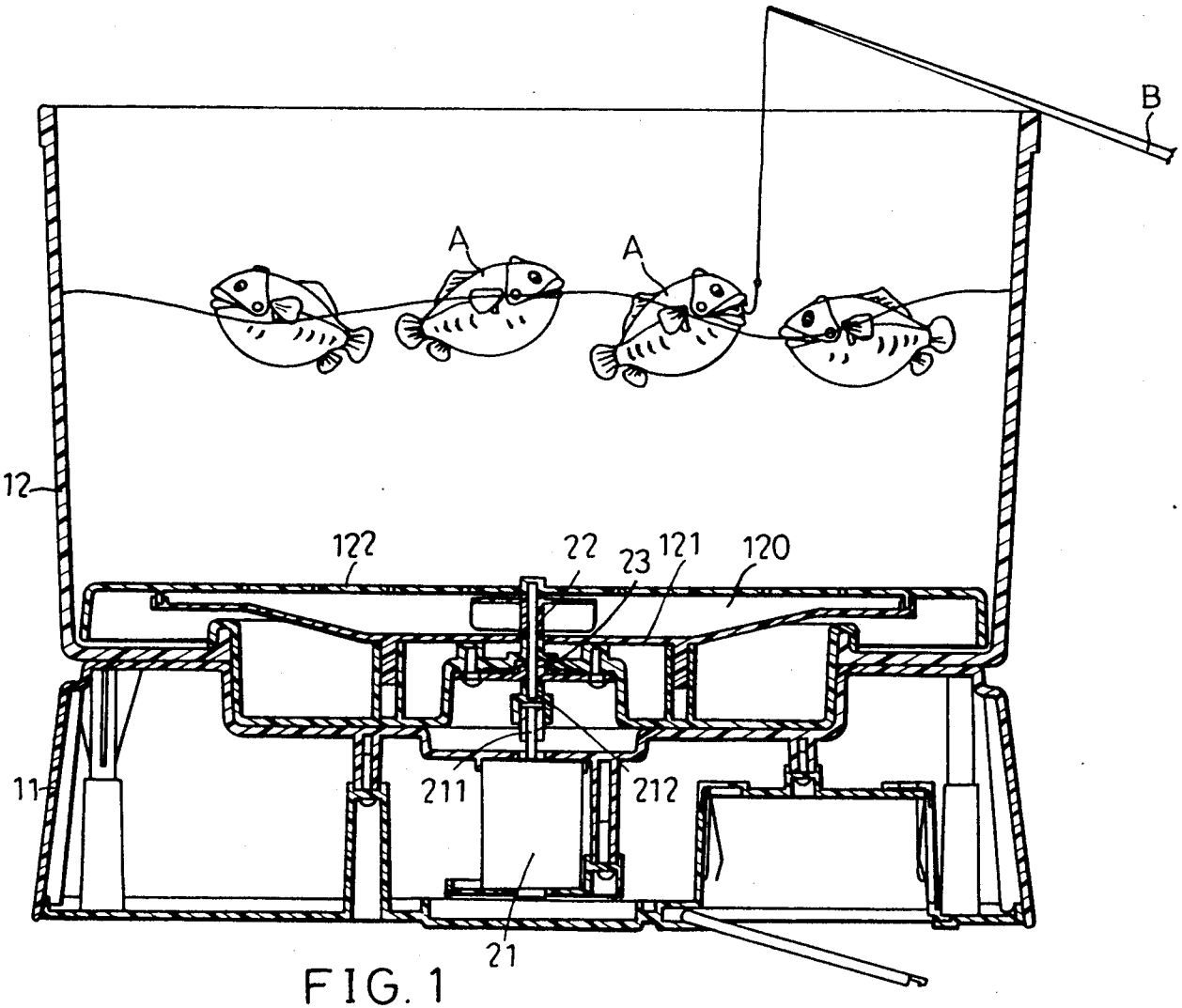
FIG. 1 is a sectional view of a first preferred embodiment of an aquatic toy device of this invention.

Referring to FIG. 1, the aquatic toy device of this invention includes a tank (12) which contains water therein and has a bottom part. The bottom part of the tank (12) includes an upper perforated plate member (122), a lower guide plate member (121) connected to the upper perforated plate member (122), and a space (120) formed between the upper perforated plate member (122) and the lower guide plate member (121). A plurality of floatable fish dolls (A) float on water in the tank (12). A base (11) is attached to the bottom part of the tank (12). A motor (21) is mounted in the base (11) and has a shaft (211). The shaft (211) of the motor (21) extends into the bottom part of the tank (12), and has a connector (212) and a sealing member (23). A propeller (22) is provided in the space (120) and connected to the connector (212). The propeller (22) forces water upwards from the space (120) through the upper perforated plate member (122) when it is actuated by the motor (21). Therefore, when the motor (21) is turned on to actuate the propeller (22), water in the tank (12) is waved and the floatable fish dolls (A) wave too. A person can amuse himself by using a fishing rod (B) to fish for the fish dolls (A).

Figure 2:
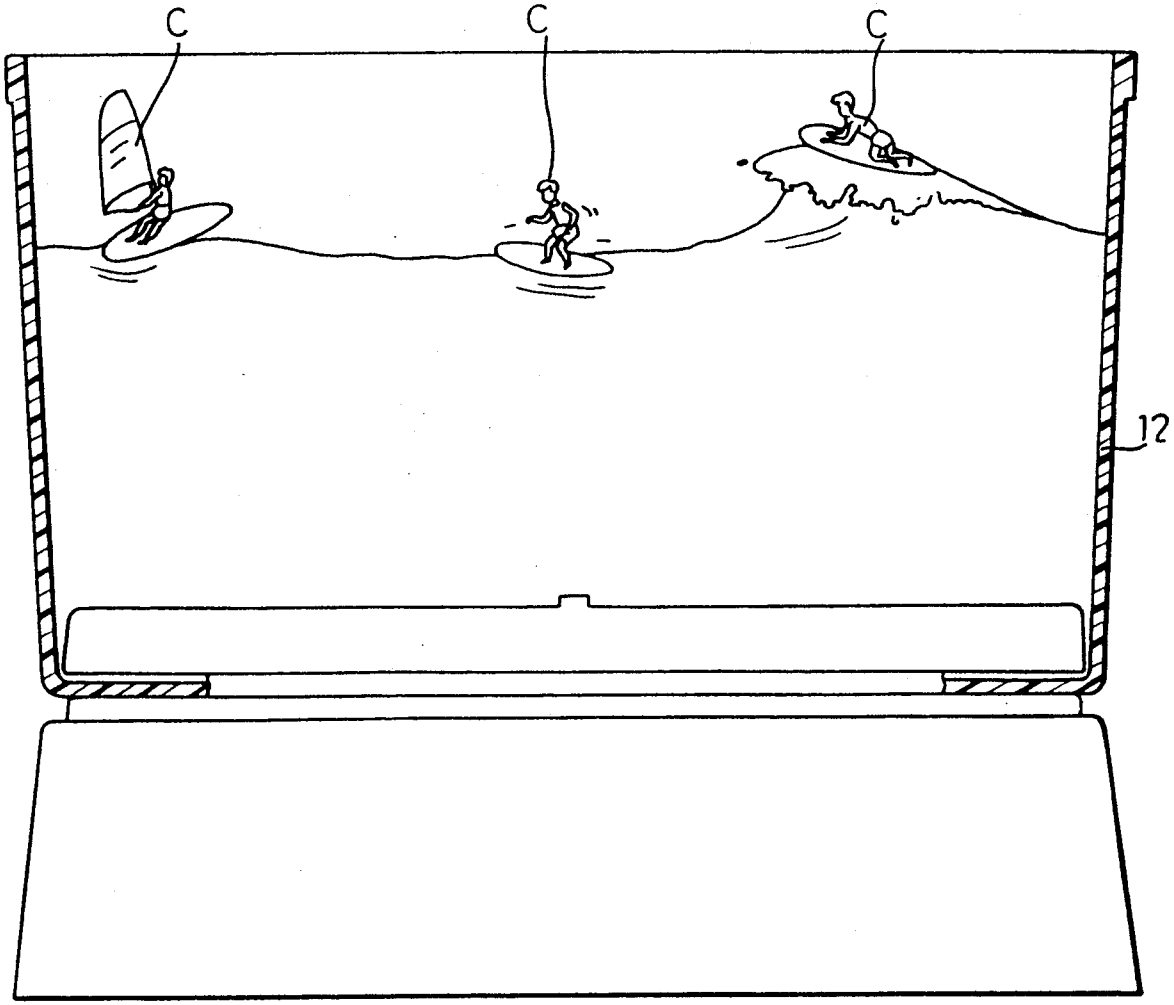
FIG. 2 shows the aquatic toy device in FIG. 1 with a surfer doll floating on the water in the tank.
Figure 3:
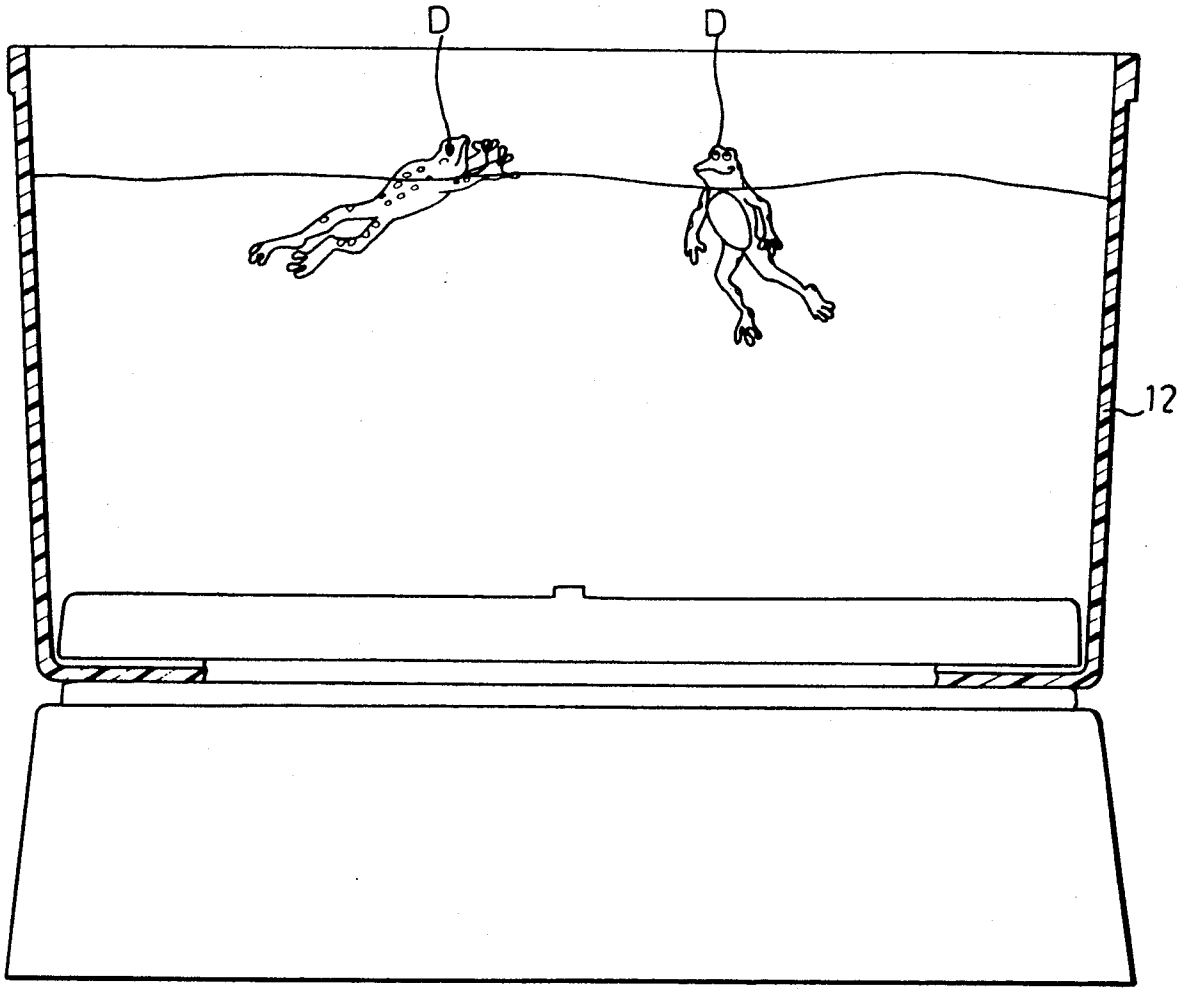
FIG. 3 shows the aquatic toy device in FIG. 1 with a frog doll floating on the water in the tank.
Figure 4:
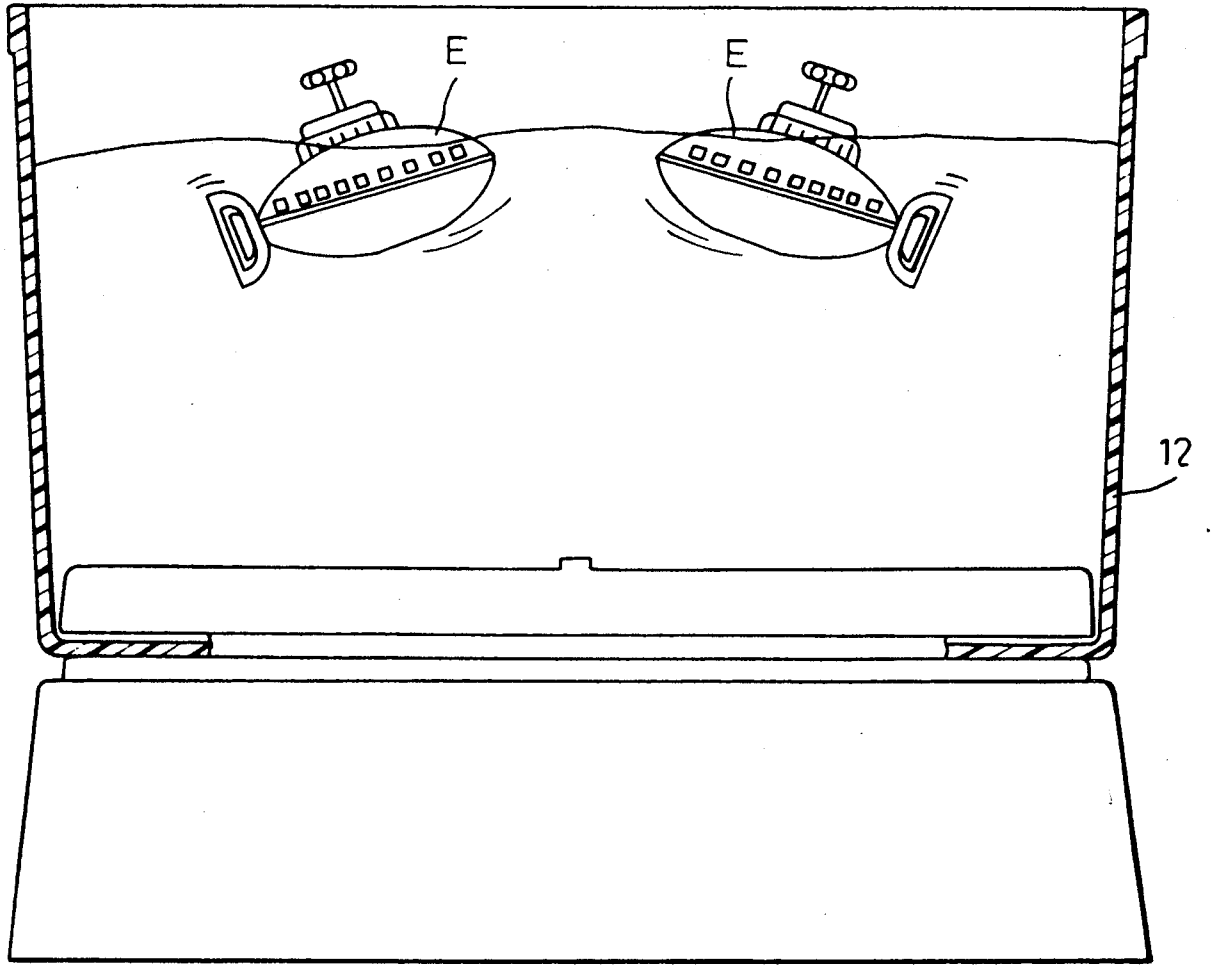
FIG. 4 shows the aquatic toy device in FIG. 1 with a submarine doll floating on the water in the tank.
Figure 5:
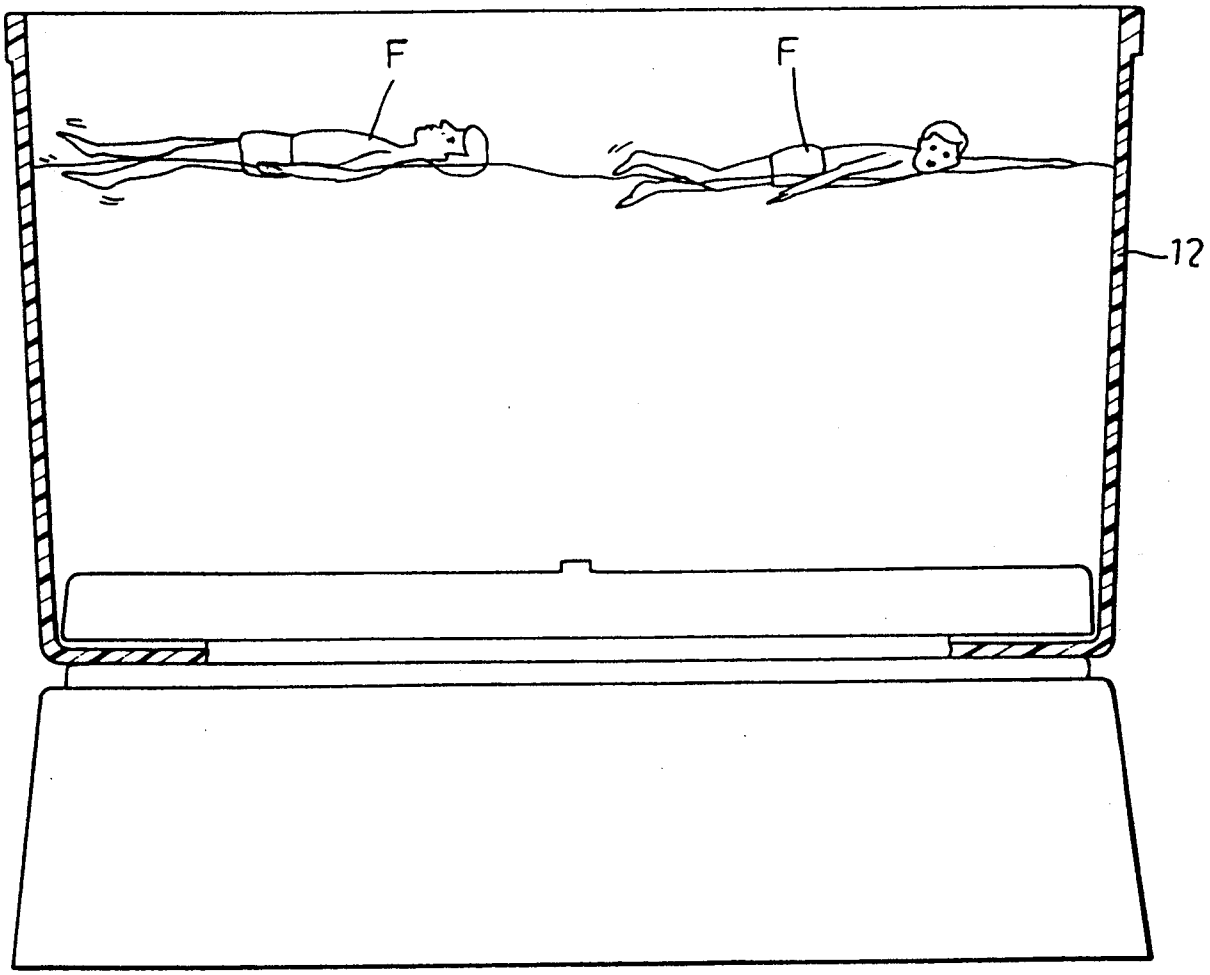
FIG. 5 shows the aquatic toy device in FIG. 1 with a swimmer doll floating on the water in the tank.
Figure 6:
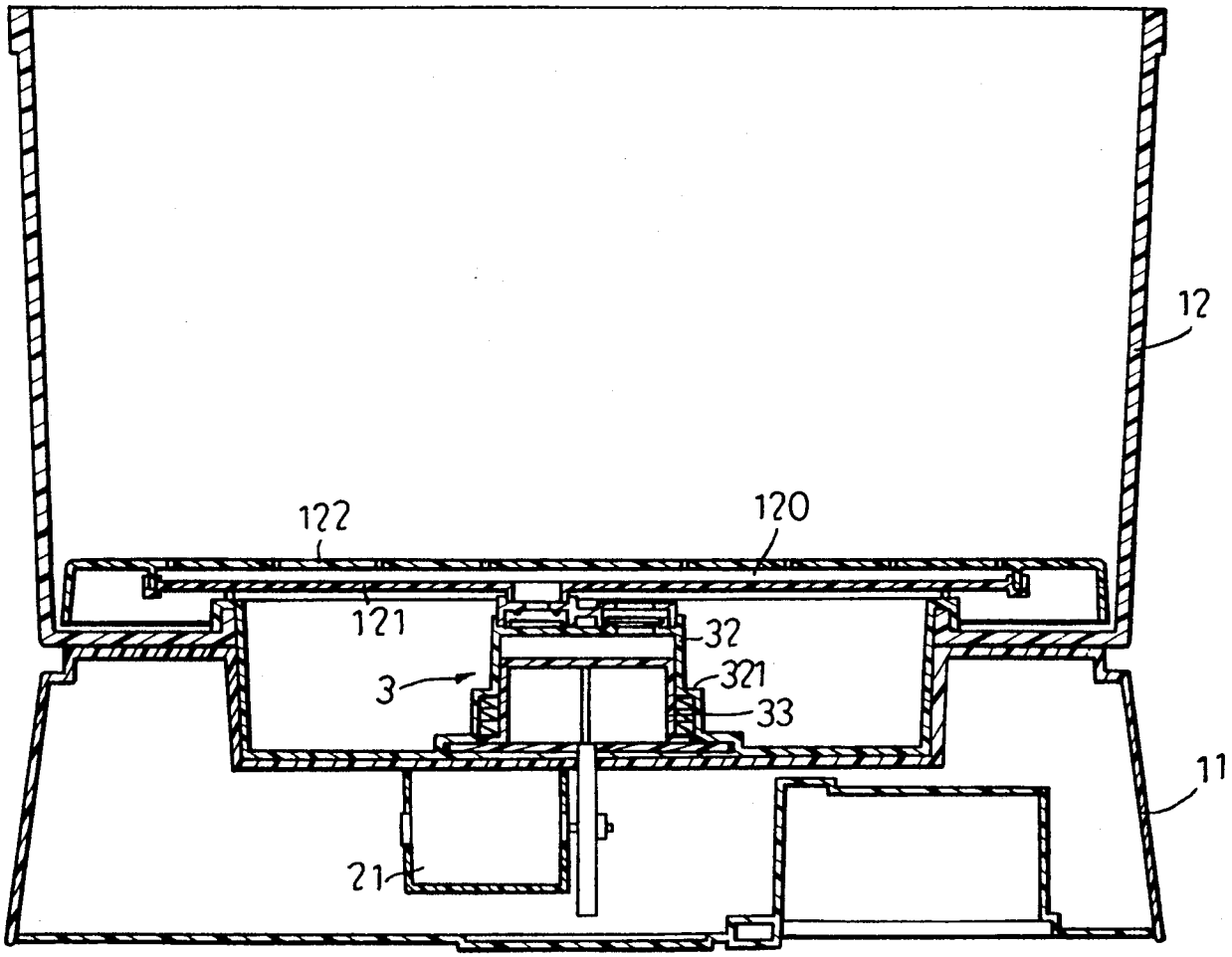
FIG. 6 is a sectional view of the second preferred embodiment of the aquatic toy device of this invention.
Figure 8:
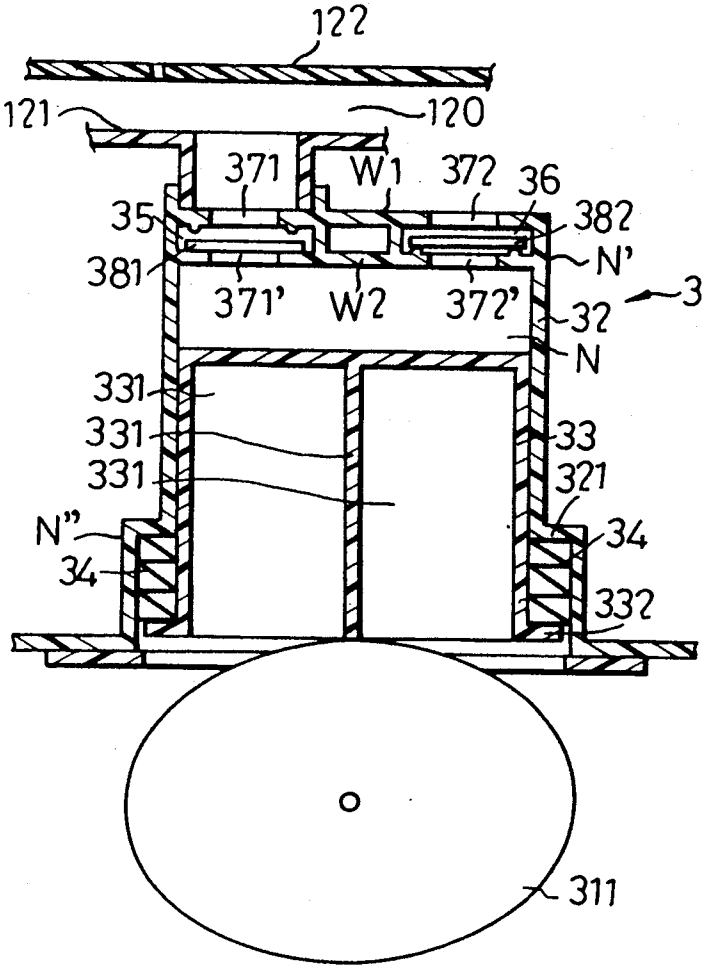
FIG. 8 is a schematic side sectional view of the piston-type propelling unit and the motor of the aquatic toy device in FIG. 6 wherein the housing is full of water.
Figure 7:
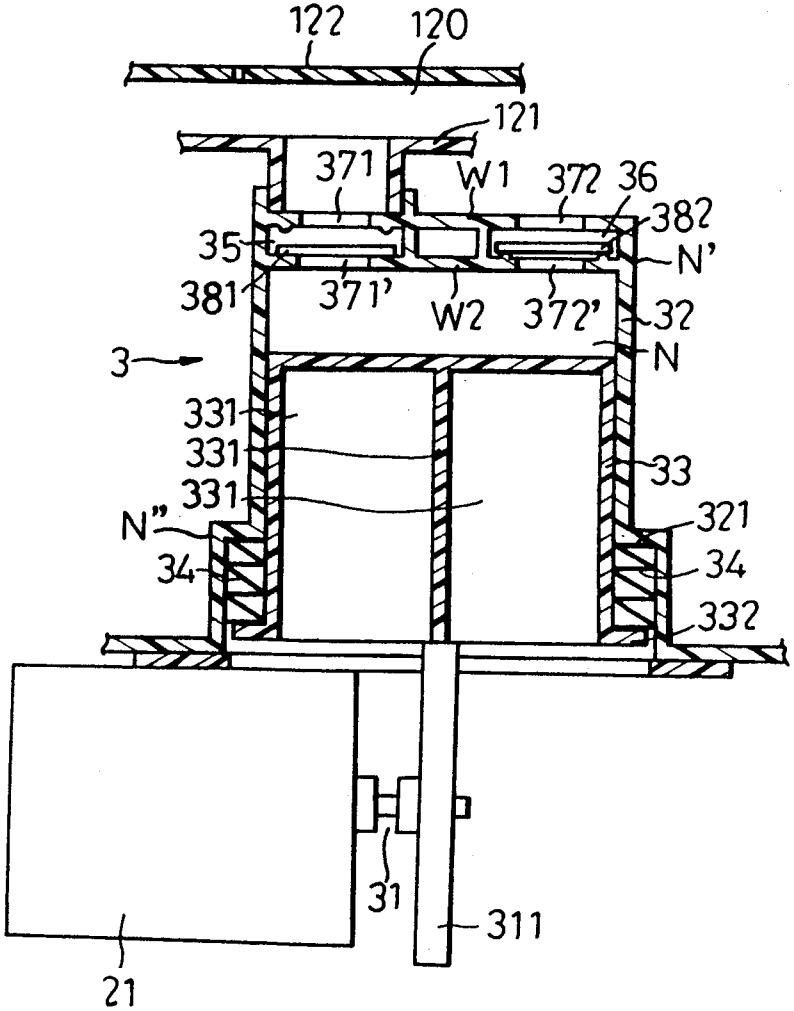
FIG. 7 is a schematic front sectional view of the piston-type propelling unit and the motor of the aquatic toy device in FIG. 6 wherein the housing is full of water.
Figure 10:
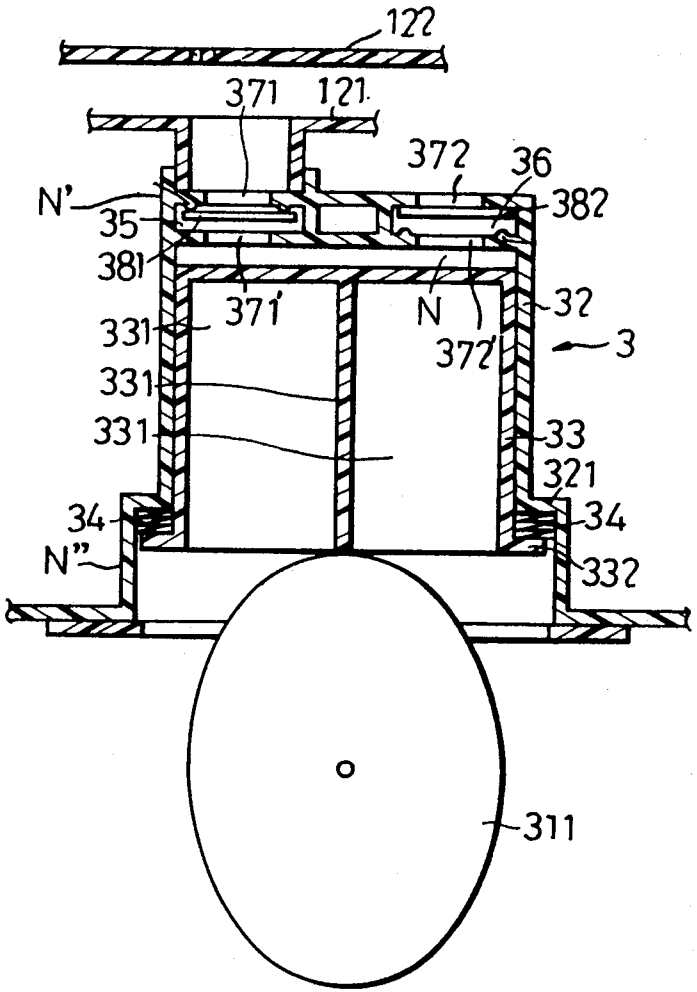
FIG. 10 is a schematic side sectional view of the piston-type propelling unit and the motor of the aquatic toy device in FIG. 6 wherein the housing sends out water.
Figure 9:
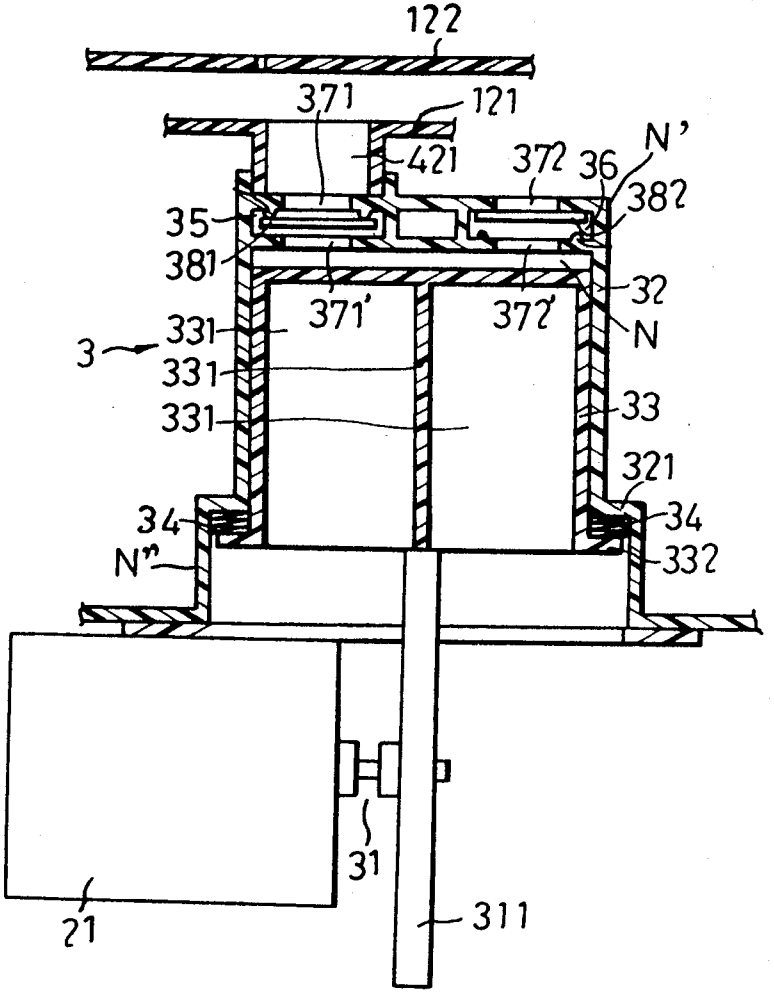
FIG. 9 is a schematic front sectional view of the piston-type propelling unit and the motor of the aquatic toy device in FIG. 6 wherein the housing sends out water.

The floatable toys floating on the water in the tank (12) may be surfer dolls (C) in FIG. 2, frog dolls (D) in FIG. 3, submarine dolls (E) in FIG. 4, and swimmer dolls (F) in FIG. 5.

FIGS. 6 to 10 show a second preferred embodiment of the aquatic toy device of this invention. All like elements are indicated by like reference numerals in FIG. 1. A piston-type propelling unit (3) is located below the lower guide plate member (121) in the bottom of the tank (12). The piston-type propelling unit (3) includes a hollow housing (32) having a top portion (N') and a bottom portion (N''), a piston member (33) mounted in the hollow housing (32), and a variable chamber (N) formed between the piston member (33) and the top portion (N'). The top portion (N') includes an upper wall (W1), a lower wall (W2) spaced from the upper wall (W1), a room formed between the upper wall (W1) and the lower wall (W2) and divided into an inlet chamber (36) and an outlet chamber (35). The top portion (N') has an inlet first opening (372) and an aligned inlet second opening (372'). The inlet first and second openings, (372) and (372'), communicate the bottom part of the tank (12) and the variable chamber (N). The top portion (N') has an outlet first opening (371), and an aligned outlet second opening (371'). The outlet first and second openings, (371) and (371'), communicate the variable chamber (N) and the space (120). An inlet check valve (382) is provided in the inlet chamber (36) to control the water flowing from the bottom part of the tank (12) into the variable chamber (N). An outlet check valve (381) is provided in the outlet chamber (35) to control the water flowing from the variable chamber (N) to the space (120). The bottom portion (N'') of the housing (32) has an outwardly extending step portion (321). The piston member (33) includes a peripheral flange (332) outwardly extending into a portion below the step portion (321), and a plurality of intersecting ribs (331) therein. A spring (34) is mounted between the step portion (321) and the peripheral flange (332) to urge the piston member (33) downwards. The motor (21) includes a shaft (31), and an elliptical cam disc (311) mounted on the shaft (31), abutting and driving the piston member (33). When the motor (21) is turned on to drive the piston member (33), water is pumped into the space (120) from the bottom part of the tank (12) through the variable chamber (N) and is forced upwards through the upper perforated plate member (122).

Figure 11:
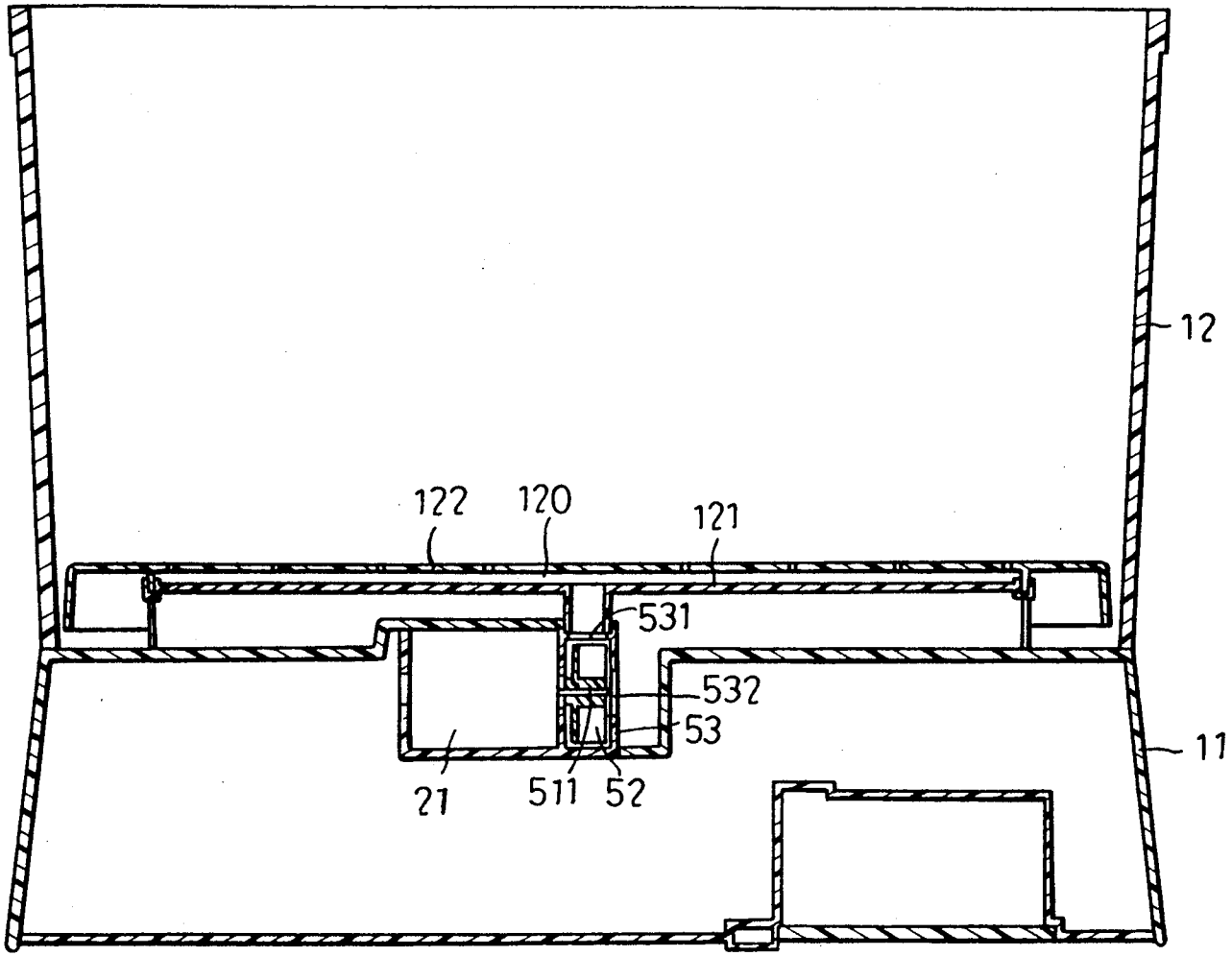
FIG. 11 is a sectional view of the third preferred embodiment of the aquatic toy device of this invention.
Figure 13:
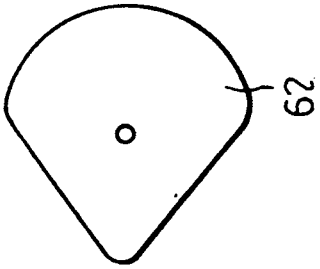
FIG. 13 is a schematic magnified view of the single blade propeller in FIG. 12.
Figure 12:
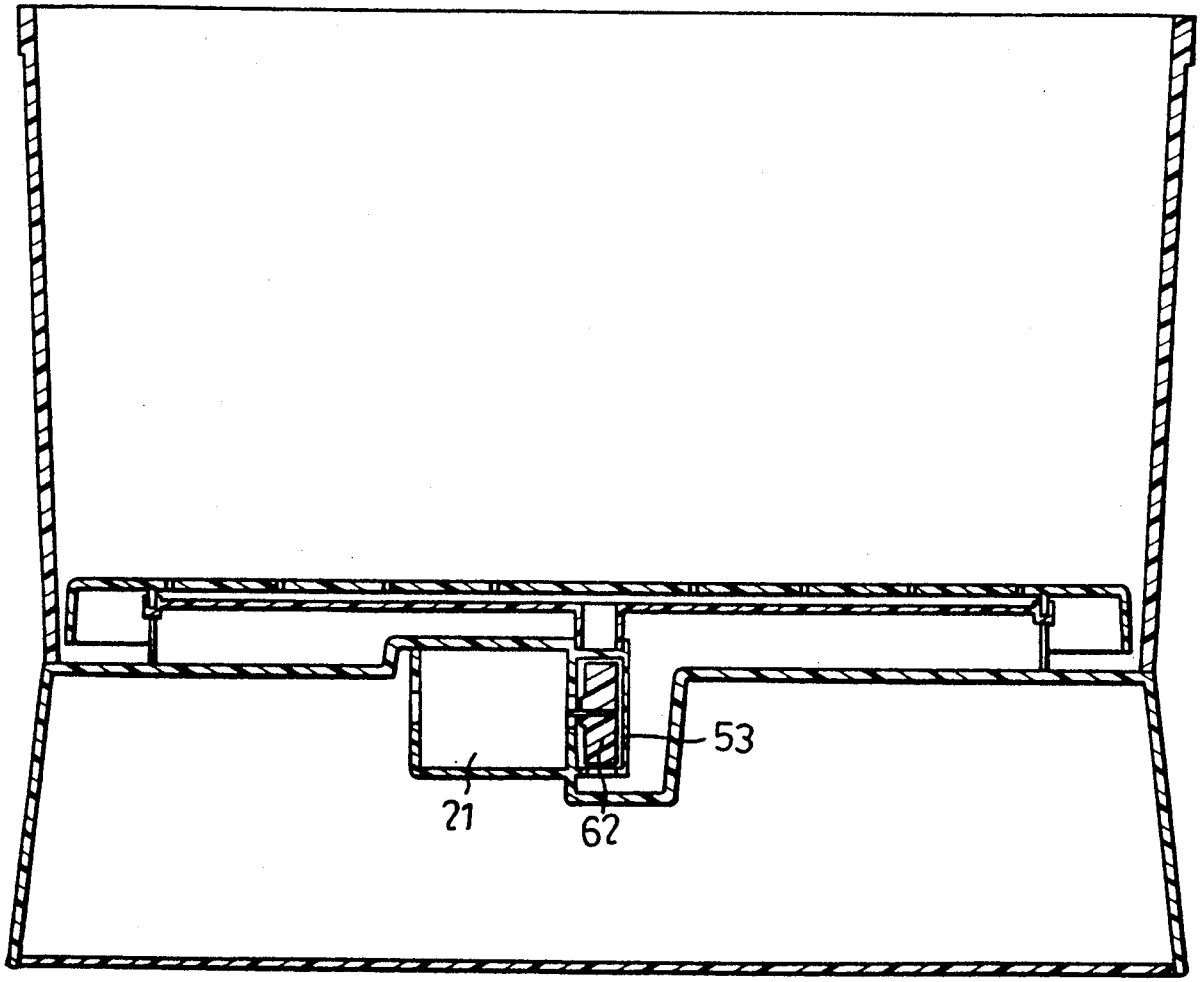
FIG. 12 shows an aquatic toy device similar to that of FIG. 11, but having a single blade propeller.

FIG. 11 shows a third preferred embodiment of the aquatic toy device of this invention. The bottom part of the tank (12) has a hollow casing (53) mounted below the lower guide plate member (121). The casing (53) has an inlet opening (532) communicating the bottom part of the tank (12) and the casing (53), and an outlet opening (531) communicating the casing (53) and the space (120). The motor (21) includes a shaft (511) extending to the bottom part of the tank (12). A propeller (52) is provided in the casing (53) and connected to the shaft (511). As in the first and second preferred embodiments explained above, when actuated by the motor (12), the water is directed to flow into the space (12) from the bottom part of the tank (12) through the casing (53) and is forced upwards through the upper perforated plate member (122). FIG. 12 shows an aquatic toy device similar to that of FIG. 11, but having a single blade propeller (62). FIG. 13 shows the schematic magnified view of the single blade propeller (62).

While the present invention has been described in connection with what is considered the most practical and preferred embodiment, it is understood that this invention is not limited to the disclosed embodiment, but is intended to cover various arrangements included within the spirit and scope of the broadest interpretations and equivalent arrangements.

I claim:

1. An aquatic toy device comprising:

a tank for containing a liquid therein, and including a bottom part having an upper perforated plate member, and a lower guide plate member connected to said upper perforated plate member so as to define a space between said upper perforated plate member and said lower guide plate member;

a base attached to said bottom part of said tank;

a liquid propelling unit provided in said bottom part of said tank to force liquid contained in said tank upwards from said space through said upper perforated plate member, when said propelling unit is actuated, so as to generate waves within said tank when filled with liquid and to cause at lest one floatable toy floating on top of said liquid to exhibit wave-like motions; and actuating means mounted in said base, and connected to said liquid propelling unit, for actuating said liquid propelling unit, said liquid propelling unit including a piston-type propelling unit located below said lower guide plate member, said piston-type propelling unit including a hollow housing having a top portion and a bottom portion, a piston member mounted in said hollow housing, and a variable chamber formed between said piston member and said top portion, said top portion having an inlet opening in fluid communication with said bottom part of said tank and said variable chamber, an outlet opening in fluid communication with said variable chamber and said space, an inlet check valve mounted adjacent to said inlet opening and controlling the liquid flowing from said bottom part of said tank into said variable chamber, and an outlet check valve mounted adjacent to said outlet opening and controlling the liquid flowing from said variable chamber into said space, said bottom portion of said housing having an outwardly extending step portion and an enlarged portion below said step portion, said piston member having a peripheral flange outwardly extending into said enlarged portion, a spring mounted between said step portion and said peripheral flange, said actuating means comprising a motor including a shaft, and a cam mounted on said shaft, abutting against and driving said piston member.

2. The aquatic toy device as claimed in claim 1, wherein said cam is an elliptical cam disc.

* * * * *